United States Patent [19]

Kanamori

[11] Patent Number: 4,781,846

[45] Date of Patent: Nov. 1, 1988

[54] ADDITIVES FOR AQUEOUS LUBRICANT

[75] Inventor: Hideo Kanamori, Ichihara, Japan

[73] Assignee: Idemitsu Kosan Limited, Tokyo, Japan

[21] Appl. No.: 61,013

[22] Filed: Jun. 1, 1987

[30] Foreign Application Priority Data

Jun. 12, 1986 [JP] Japan ..... 61-136726

[51] Int. Cl.[4] ..... C10M 173/00

[52] U.S. Cl. ..... 252/49.3; 252/49.5; 252/50; 252/51.5 A; 252/51.5 R

[58] Field of Search ..... 252/49.3, 49.5, 50, 252/51.5 A, 51.5 R; 544/398, 399

[56] References Cited

U.S. PATENT DOCUMENTS 2,508,653 5/1950 Malkemus et al. ..... 544/399

2,574,407 11/1951 Malkemus et al. ..... 544/399

4,663,063 5/1987 Davis ..... 252/51.5 A

*Primary Examiner*—Jacqueline V. Howard

*Attorney, Agent, or Firm*—Browdy and Neimark

[57] ABSTRACT

Disclosed is an additive for aqueous lubricants which can provide aqueous lubricants excellent in bacteriocidal action, rust proofness, emulsifiability and dissolvability and show no deterioration during use. This additive contains a piperazine compound represented by the general formula [I] or a reaction product of said piperazine compound with a carboxylic acid of 2-55 carbon atoms:

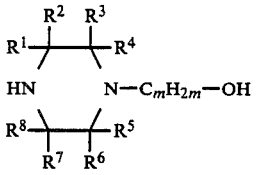

wherein $R^1$–$R^8$ represent hydrogen atom or alkyl group of 1–18 carbon atoms and m is an integer of 1–5. This additive may further contain an emulsifier or a lubricating oil.

13 Claims, No Drawings

ADDITIVES FOR AQUEOUS LUBRICANT

BACKGROUND OF THE INVENTION

This invention relates to additives for aqueous lubricants. Many aqueous lubricants have been generally known which contain various emulsifiers and solubilizers, but because of poor bactericidal action these aqueous lubricants are susceptible to damage by bacteria and so their life is shortened.

In an attempt to solve the above problem, it has been proposed to add some piperazine compounds to lubricants.

For example, there have been known aqueous lubricants containing piperazines or alkylpiperazines (U.S. Pat. Nos. 3,089,854 and 3,260,669), aqueous lubricants containing N-aminoethylpiperazine (Japanese Patent Unexamined Publication No. 67792/83), aqueous lubricants containing 1,4-piperazine ethanol (U.S. Pat. No. 2,441,793), etc.

Furthermore, phosphate ester lubricants comprising a phosphate ester contain various piperazine compounds (including those which are represented by the general formula [I] referred to hereinafter) which are not aqueous lubricants.

However, these aqueous lubricants and phosphate ester lubricants have the problems that bactericidal effects are still not sufficient. They become high molecular substances with heat or the like during their use as agents to cause adherence to the lubricated part or change of properties such as the formation of insoluble substances. In addition, their properties of rust emulsifiability and solubilizability are not proofing.

SUMMARY OF THE INVENTION

Accordingly, the object of this inventin is to provide an additive for aqueous lubricants which can give aqueous lubricants which are excellent in bactericidal action, do not deteriorate during use as a lubricant and are excellent in rust proofing, emulsifiabiltiy and solubilizability.

DESCRIPTION OF THE INVENTION

As a result of the inventors' intensive researches to achieve the above object, it has been surprisingly found that among a number of piperazine compounds, those having a specific structure satisfy the above object and furthermore, an additive for aqueous lubricants which comprises said piperazine compound having a specific structure and a specific carboxylic acid further sufficiently achieves the above object.

The gist of this invention for attaining the above object are as follows:

Additives for aqueous lubriants which contain a piperizine compound represented by the general formula [I]:

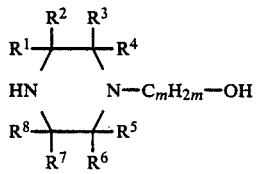

[I]

(wherein m represents an integer of 1–5 and $R^1$–$R^8$ each represents hydrogen atom or an alkyl group of 1–18 carbon atoms).

Additives for aqueous lubricants which contain a reaction product of said piperazine compound represented by the general formula [I] with carboxylic acid of 2–55 carbon atoms.

That is, one important point of this invention is to use, as an additive for an aqueous lubricant, a piperazine compound, an N-(mono hydroxyalkyl)piperazine compound, of the specific structure represented by the general formula [I] or a reaction product of said piperazine compound with a specific carboxylic acid.

Among the piperazine compounds represented by the general formula [I], preferred are those of the general formula [I] where $R^1$–$R^8$ are a hydrogen atom, a methyl group or an ethyl group; especially preferred are those where $R^1$–$R^8$ are hydrogen atom.

Furthermore, m in the general formula [I] is preferably 1–3 and especially preferably 2 or 3.

The position of —OH group in —$C_mH_{2m}$—OH in the general formula [I] has no special limitation, but a 2-hydroxyalkyl group is especially preferred.

As examples of said piperazine compounds, mention may be made of various hydroxyalkylpiperazine compounds such as N-(hydroxymethyl)piperazine, N-(hydroxymethyl)-1-methylpiperazine,
N-(2-hydroxyethyl)piperazine [$R^1$–$R^8$ are hydrogen atom and —$C_mH_{2m}$—OH is —$CH_2$ $CH_2$ OH in the general formula [I]],
N-(2-hydroxymethyl)-1-methylpiperazine, N-(1-hydroxyethyl)piperazine,
N-(2-hydroxyethyl)-1, 2-dimethylpiperazine,
N-(2-hydroxyethyl)-1-ethylpiperazine,
N-(2-hydroxyethyl)-1-butylpiperazine,
N-(2-hydroxyethyl)-1-cyclohexylmethylpiperazine,
N-(hydroxyethyl)-1, 4-dimethylpiperazine,
N-(2-hydroxyethyl)-1, 2, 3, 4-tetramethylpiperazine,
N-(2-hydroxyethyl)-1, 1-dimethylpiperazine,
N-(2-hydroxypropyl)piperazine,
N-(2-hydroxypropyl)-1-methylpiperazine,
N-(3-hydroxypropyl)-piperazine,
N-(3-hydroxypropyl)-1-methylpiperazine, N-(2-hydroxybutyl)piperazine,
N-(2-hydroxybutyl)-1-methylpiperazine, N-(4-hydroxybutyl)piperazine,
N-(2-hydroxybutyl)piperazine, N-(5-hydroxypentyl)-piperazine,
N-(2-hydroxy-3-methylbutyl)piperazine, etc.

Among these compounds, preferred are N-(hydroxymethyl)piperazine, N-(hydroxymethyl)-1-methylpiperazine, N-(2-hydroxyethyl)piperazine, N-(hydroxyethyl)-1-methylpiperazine, N-(2-hydroxypropyl)piperazine, N-(2-hydroxypropyl)-1-methylpiperazine, N-(3-hydroxypropyl)piperazine, N-(3-hydroxypropyl)-1-methylpiperazine and especially preferred are N-(2-hydroxyethyl)piperazine and N-(2-hydroxypropyl)piperazine.

These piperazine compounds may be used alone or in combination of two or more.

Any carboxylic acids may be used as long as they have 2–55 carbon atoms and, for example, there maybe used fatty carboxylic acids, naphthenic carboxylic acids, aromatic carboxylic acids, saturated carboxylic acids, unsaturated carboxylic acids, monovalent carboxylic acids (monobasic acids), dibalent carboxlic acids (dibasic acids), polyvalent carboxylic acids, etc. Mono- or divalent carboxylic acids of 4–44 carbon atoms are preferred.

As typical examples of said carboxylic acids, mention may be made of formic acid, acetic acid; propanoic acid; butyric acid, isobuturic acid; pentanoic acids such as valeric acid and isovaleric acid; hexanoic acid such as caproic acid, hexanoic acid, isohexanoic acid, heptanoic acid, isoheptanoic acid; octanoic acid such as caprilic acid, isooctanoic acid; nonanoic acid, isononanoic acid; decanoic acid such as capric acid, isodecanoic acid; undecanoic acid, isoundecanoic acid; dodecanoic acid such as lauric acid, isododecanoic acid tridecaoic acid, tetradecanoic acid such as myristic acid, isotetradecanoic acid; pentadecanoic acid, isopentadecanoic acid; hexadecanoic acid such as palmitic acid, isohexadecanoic acid; heptadecanoic acid; octadecanoic acid such as stearic acid, isooctadecanoic acid; nonadecanoic acid, eicosanoic acid ($C_{20}$), isoeicosanoic acid, heneicosanoic acid, docosanoic acid such as behenic acid; isodocosanoic acid; tricosanoic acid, glyceric acid, isotetracosanoic acid, pentacosanoic acid, isopentacosanoic acid, cerotic acid, isohexacosanoic acid, heptacosanoic acid, octacosanoic acid, octacosanoic acid, isooctacosanoic acid, montanic acid, isononacosanoic acid, triacontanoic acid ($C_{30}$) such as melissic acid, isotriacontanoic acid; monovalent saturated fatty acid such as hentriacontanoic acid, dotriacontanoic acid, tetratriacontanoic acid, pentatriacontanoic acid, hexatriacontanoic acid, heptatriacontanoic acid, octatriacontanoic acid, nonatriacontanoic acid, tetracontanoic acid, octatetracontanoic acid, pentacontanoic acid, etc.; monovalent unsaturated fatty acids such as crotonic acid, isocrotonic acid, hexenoic acid, sorbic acid, octenoic acid, decenoic acid, undecenoic acid, dodecenoic acid, tetradecenoic acid, hexadecenoic acid, octadecenoic acid (oleic acid, elaidic acid, etc.), linolic acid, linoleic acid, stearolic acid, ricinoleic acid, eicosenoic acid, docosenoic acid, triacontenoic acid, hexatriacontenoic acid, tetracontenoic acid, etc.; divalent-polyvalent saturated fatty acids andunsaturated acids such as oxalic acid, malonic acid, succinic acid, fumaric acid, maleic acid, pentanedioic acid such as glutaric acid, isopentanedioic acid, itaconic acid, hexanedioic acid such as adipic acid, hexenedioic acid heptanedioic acid, octanedioic acid, isooctanedioic acid, octenedioic acid such as tetramethylsuccinic acid, decanedioic acid such as sebacic acid, isodecanedioic acid, dodecanedioic acid, isododecanedioic acid, tridecanedioic acid, tetradecanedioic acid, tetradecenedioic acid, hexadecanedioic acid, isohexadecanedioic acid, hexadecenedioic acid, octadecanedioic acid, isooctadecanedioic acid, octadecenedioic acid, eicosanedioic acid, isoeicosanedioic acid (7-ethyloctadecanedioic acid, docosanedioic acid, isodocosanedioic acid, tricosanedioic acid, tetracosanedioic acid, pentacosanedioic acid, hexacosanedioic acid, octacosanedioic acid, triacontanedioic acid, triacontanedioic acid, hexatriacontanedioic acid, hexatriacontenedioic acid, tetracontanedioic acid, pentacontanedioic acid, tetrapentacontanedioic acid, tetrapentacontenedioic acid, dimeric acids (dimers of linolenic acid, etc.), trimeric acids (trimers of linolenic acid, etc.), etc.; cyclic hydrocarbon carboxylic acids such as cyclohexanecarboxylic acid, cyclohexanedicarboxylic acid, norbornane-3, 4-dicarboxylic acid, etc.; aromatic carboxylic acids such as benzoic acid, phthalic acid, isophthalic acid, terephthalic acid, trimellitic acid, tetramellitic acid, etc. Of these compounds, monovalent or divalent carboxylic acids of 4–44 carbon atoms are preferred and monovalent or divalent carboxylic acids of 10–20 carbon atoms are especially preferred. Specifically, oleic acid, sebacic acid and 7-ethyl-octadecanedioic acid are preferred.

These carboxylic acids may be used alone or in combination of two or more.

The additives for aqueous lubricants of this invention may comprise only said piperazine compound, said piperazine compound and said carboxylic acid or a reaction product of said piperazine compound with said carboxylic acid.

Preferable additives for aqueous lubricants are those which contain the reaction product of the piperazine compound with the carboxylic acid. The additives containing this reaction product are superior in rust proofing to those containing only the piperazine compound.

The aqueous lubricants according to this invention can be prepared by mixing water, said piperazine compound represented by the general formula [I] and if necessary, an emulsifier and a lubricating oil.

The aqueous lubricants according to this invention can also be prepared by mixing said piperazine compound, said caboxylic acid, water and if necessary, an emulsifier and a lubricating oil.

As said emulsifier, there may be used any nonionic surface active agents, anionic surface active agents, cationic surface active agents and amphoteric surface active agents. It is also possible to use mixed emulsifiers such as mixtures of nonionic surface active agents and ionic surface active agents, etc. That is, there may be used various emulsifiers (surface active agents) added to the known aqueous lubricants.

As typical examples thereof, mention may be made of soaps such as natural fatty acid sodium salts, etc.; synthetic soaps such as synthetic higher fatty acid sodium salts, etc.; alkylsulfates such as sodium alkylsulfates, sodium oleic acid alkylsulfates, etc.; alkylaromatic sulfonates such as sodium alkylbenzenesulfonates, sodium alkylnaphthalenesulfonates, etc.; anionic surface active agents such as sodium dialkylsulfosuccinates, etc.; cationic surface active agents such as halogenated trimethylaminoethylalkylamides, alkylpyridiniumsulfates, quaternary amine salts such as halogenated alkyltrimethylammonium, etc.; nonionic surface active agents such as polyoxyethylenealkyl ether, polyoxyethylene fatty acid esters, polyoxyethylenealkylphenyl ethers, polyhydric alcohol fatty acid esters, sucrose fatty acid esters, etc.; amphoteric surface active agents such as alkyltrimethylaminoacetic acid, alkyldiethylenetriaminoacetic acid, etc.

Specific examples of the above surface active agents (commercially available) are shown in "Table of Surface Active Agents, etc.: Japan Surface Active Agent Industrial Society (1981)".

These surface active agents may be used alone or in combination of two or more.

Among the above surface active agents, suitable are mixed emulsifiers of nonionic surface active agents and anionic surface active agents and especially preferred are mixed emulsifiers of polyoxyethylenealkylphenyl ethers and alkylaromatic sulfonates.

The lubricating oils used in this invention have no special limitation and there may be used any of petroleum oil or mineral oil lubricants (such as paraffinic oils and/or naphthenic oils), non-petroleum lubricating oils (such as animal oils, vegetable oils, synthetic lubricating oils), etc. or mineral oils, synthetic oils, animal and vegetable oils used therefor. It is also possible to use light lubricating oils, medium lubricating oils, heavy lubricating oils, etc. As more specific examples, mention may be made of lubricating oils for metal working (e.g., plastic working oils such as rolling oil, pressing oil, drawing oil and cutting and grinding oils), lubricating oils for actuation (such as aircraft actuation oil, automobile brake oil, hydraulic oil, torque converter oil, etc.), heat treating oils, rust proofing lubricating oils, industrial lubricating oils, spindle oils, refrigerator oils, dynamo oils, turbine oils, machining oils, cylinder oils, various gear oils, automatic transmission oils, lubricating oils for various internal combustion engenes, sliding surface oils, etc. or mineral oils, synthetic oils, animal and vegetable oils used therefor.

Among these oils, preferred are lubricating oils for metal working such as plastic working oil, cutting oil, etc., actuation lubricating oils, heat treating oils or mineral oils, synthetic oils used therefor and especially preferred are lubricating oils comprising naphthenic mineral oils of 2–500 cst (40° C.) to which 0.5–30% by weight of sulfurized fatty oil is added.

In general, a base solution (said piperazine compound, a mixture of said piperazine compound and carboxylic acid or a reaction product of said piperazine compound with said carboxylic acid with addition of no or a small amount of water) is first prepared and this is used as it is or is diluted with water to less than 250 times and used. Therefore, blending ratio of piperazine (component [A], carboxylic acid of 2–55 carbon atoms (component [B]), emulsifier (component [C]) and lubricating oil (component [D]) cannot be unconditionally determined, but may be generally specified as follows.

That is, component [B]/component [A] (molar ratio) is generally 0–5, especially preferably 0–1 for the undiluted base solution.

Blending ratio of component [A], component [C], component [D] and water is generally 0.1–100% by weight of component [A], 0–50% by weight of component [C], 0–95% by weight of component [D] and 0–70% by weight of water for the undiluted base solution.

The base solution of such composition is used as it is or is diluted to less than 250 times with water and used.

Sequence and method of blending these component [A], component [B], component [C], component [D] and water have no special limitation, but, for example, the following method is suitable.

That is, when carboxylic acid is not used, component [A] and, if necessary, component [C] and component [D] are blended and the resulting blend is blended with water.

When carboxylic acid is used, component [A], component [B] and, if necessary component [C] and component [D] are blended and the resulting blend is blended with water or component [A] and component [B] are blended, the resulting blend is stirred at room temperature-150° C., preferably 30°–100° C. for 5–120 minutes, preferably 10–60 minutes to previously react component [A] with component [B] and then, if necessary, this reaction solution is blended with component [C] and component [D] and thereafter, the blend is blended with water.

The additives for aqueous lubricants according to this invention may contain, in addition to component [A] or a reaction product of component [A] with component [B], such additives which are normally added to lubricants such as antioxidants, cleaning agents, viscosity modifiers, lubricating agents, extreme pressure agents, antifoamers, rust proofing agents, etc. Furthermore, if necessary, there may be added other additives, for example, amines such as diethanolamine, etc., piperazine compounds other than those of the general formula [I], water repellents, sticking agents, colorants, etc.

As the antioxidants, there may be used aromatic amine antioxidants, phenolic antioxidants, dialkyldithiophosphate antioxidants, phosphorus and sulfur compound antioxidants, phosphorus compound antioxidants such as, for example, 2, 6-ditertiarybutoxy para-cresol, tetramethylaminodiphenylmethane, phenothiazine, zinc dialkyldithiophosphate, 2, 2'-methyhlenebis (4-methyl-6-tertiarybutylphenol), 4, 4'-methylenebis(2,6-ditertiarybutylphenol), N,N'-di-secondary-butyl-p-phenylenediamine, 2, 2'-thiobis(4-methyl-6-tertiarybutylphenol), etc.

As examples of the cleaning agents, mention may be made of multi-polar polymer cleaning agents, alkenylsuccinimide, petroleum calcium sulfonate, basic barium sulfonate, sulfurized phenol carboxylates, polyolefin dichloride cleaning agents, thiophosphates, etc.

As examples of viscosity modifiers, mention may be made of viscosity index improvers such as polybutene, polymethacrylates, etc., chlorinated paraffin-naphthalene condensates, pour point depressants such as polymethacrylates, etc.

As the oiliness agents, there may be used, for example, long chain compounds having polar groups such as higher alcohols, higher ketones, higher amines, metallic soaps, fats, etc.

As the extreme pressure agents, there may be used, for example, chlorine compound extreme pressure agents, sulfur compound extreme pressure agents, phosphorus-containing compound extreme pressure agents, etc.

As the antifoamers, there may be used, for example, silicone oils (organosilicone polymers such as polymethylsiloxane, etc.), etc.

As the rust proofing agents, mention may be made of polar group-containing compounds such as sulfonates, amines, organic acids or salts or esters thereof.

When component [A], a blend of component [A] and component [B] or a reaction product of component [A] and component [B] is used, the above various additives may be added to them, but when these additives have already been added to component [D] (lubricating oil), the additives may not necessarily be further added. In this sense, it is desirable to use a lubricating oil (component [D]) containing these additives.

The aqueous lubricants containing piperazine and those mixed with the additive containing a reaction product of piperazine with a carboxylic acid according to this invention are excellent in bactericidal action, for example, for aerobic bacteria, anaerobic bacteria, sulfate-reducing bacteria, fungi, etc., namely, are markedly high in resistance to rotting; do not emit an offensive odor; do not denature, namely, do not change to high molecular substances, do not stick to lubricating parts and do not produce insoluble substances when used as a lubricating agent and have superior in rust proofing capability, emulsifiability and solubilizability.

A lubricant containing a lubricating agent and the additive for aqueous lubricants of this invention can sufficiently exhibit smooth lubricating action even under such severe conditions where hitherto various problems have occurred. When the lubricating conditions are mild, the additive per se acts as a lubricant.

According to this invention, there is provided a novel additive which can give aqueous lubricants which are excellent in bactericidal action and rot proofing, cause no troubles due to deterioration during use as lubricating agents and further, are superior in rust proofness and emulsifiability and dissolvability. These remarkable effects are obtained mainly by using the specific piperazine compound, the piperazine compound and carboxylic acid or the reaction product of the specific piperazine compound with the carboxylic acid.

EXAMPLES 1-8 AND COMPARATIVE EXAMPLE

Aqueous lubricants were prepared by blending the components shown in Table 1 at the ratio (% by weight) as shown in Table 1 and diluted with water at the ratios of dilution as shown in Table 1, if dilution should be effected. The resulting aqueous lubricants were examines for bactericidal action, rust proofing, emulsion or solution stability and deterioration. The results are shown in Table 1. In the examples where carboxylic acids were used, the carboxylic acid was previously reacted with the nitrogen compound shown in Table 1 at 50° C. for 30 minutes and the reaction product was used.

Methods used for evaluation of the properties are as follows:

Bactericidal action: Aerobic bacteria, anaerobic bacteria, sulfate-reducing bacteria, fungi and yeasts were inoculated in the lubricants and were cultivated at 30° C. for 14 days. Thereafter, the number of surviving bacteria was measured to evaluate the rate of propagation (degree of rot proofing). That is, each lubricant was diluted with tap water to 50 times and 20 ml thereof was taken in a test tube. Then, 200 mg of cutting powder of a casting and one drop of rotten oil were added thereto and static cultivation was effected under the above conditions. For measurement of the number of surviving bacteria, the following culture media and methods were employed.

(1) Aerobic bacteria (agar plate method, broth)

Composition of culture medium:

meat extract 0.5%, peptone 1.0%, sodium chloride 0.5%, agar 1.5% (pH 7.0)

(2) Anaerobic bacteria (rollertube method using VL base medium)

Composition of culture medium:

peptone 1.0%, yeast extract 0.5%, heart extract 0.14%, glucose 0.2%, pottasium dihydrogenphosphate 0.045%, pottassium hydrogen phosphate 0.045%, ammonium sulfate 0.09%, sodium chloride 0.09%, magnesium sulfate (anhydrous salt) 0.009%, calcium chloride (anhydrous salt) 0.09%, agar 1.5%, cystine hydrochloride 0.03%, sodium hydroxide 0.4% (pH 7.0)

(3) Sulfate-reducing bacteria (roller tube method) Starch culture medium [American Type Culture Collection the 12th edition, page 331 (1976)] to which 1.5% of agar was added.

(4) Fungi and yeast (ager plate method)

Potato dextrose agar medium: potato exudation 200 g/l, glucose 20 g/l, agar 15 g/l (pH 4.0)

Numbers of bacteria at the time of addition of the rotten oil were as follows:

Aerobic bacteria: $2.0\times10^5$/ml

Anaerobic bacteria: $1.1\times10^4$/ml

Sulfate-reducing bacteria: $5.3\times10^2$/ml

Fungi: $3.0\times10^2$/ml

Yeast: $1.5\times10^4$/ml

Rust proofing:

FCD-40 material was cut by a drilling machine using an end mill tool with feeding of sample oil (cutting oil). Thereafter, occurrence of rust on the cut material was examined for 7 days to evaluate the rust proofing of the cutting oil.

Emulsion or solution stability:

100 ml of sample solution was left to stand in a measuring cylinder for 1 month and then, the degree of separation was examined.

Deterioration test:

50 ml of sample oil was taken in a 200 ml glass beaker, then, stirred at 65°-75° C. for 24 hours and left to stand at room temperature for 30 minutes. Thereafter, water was added to make up 50 ml, followed by stirring for 10 minutes. Then, visual examination was effected on whether viscous substance stuck to the wall of the beaker or not and whether the emulsion or aqueous solution was homogeneous (including emulsified state) or heterogeneous (including unemulsified state).

TABLE 1

| | | Example | | | | | | | | | | Comparative Examples | | | |
|---|---|---|---|---|---|---|---|---|---|---|---|---|---|---|---|
| | | 1 | 2 | 3 | 4 | 5 | 6 | 7 | 8 | 9 | 10 | 1 | 2 | 3 | 4 |
| *8 | N—(2-hydroxyethyl)piperazine | 5 | | 2.5 | 2.5 | 5 | 5 | 5 | 30 | 50 | 5 | | | | |
| | N—(2-hydroxypropyl)piperazine | | 5 | 2.5 | | | | | | | | | | | |
| | N,N'—bis(2-hydroxyethyl)piperazine | | | | | | | | | | | 5 | | | |
| | Piperazine | | | | | | | | | | | | 5 | | |
| | N—aminoethyl piperazine | | | | | | | | | | | | | 5 | |
| | Diethanolamine | | | | 2.5 | | | | | | | | | | 5 |
| *9 | Oleic acid | 5 | 5 | 5 | 5 | | | | | | 5 | 5 | 5 | 5 | 5 |
| | Sebacic acid | | | | | 5 | | | 10 | | | | | | |
| | Dibasic acid of 20 carbon atoms *1 | | | | | | 5 | | | | | | | | |
| Emulsifier *2 | | 12 | 12 | 12 | 12 | 35 | 30 | 30 | | | 12 | 12 | 12 | 12 | 12 |
| Lubricating oil *3 | | 78 | 78 | 77 | 77 | 54 | 59 | 65 | | | 78 | 77 | 77 | 77 | 78 |
| Water | Water | 0 | 0 | 1 | 1 | 1 | 1 | 0 | 60 | 50 | 0 | 1 | 1 | 1 | 0 |
| | Diluting ratio | (20) | (20) | (20) | (20) | (20) | (20) | (20) | (10) | (200) | (20) | (20) | (20) | (20) | (20) |
| Bacteriocidal action | Aerobic bacteria | 0 | 0 | 0 | 0 | 0 | 0 | 0 | 0 | 0 | 0 | $10^6$ | 0 | 0 | $10^6$ |
| (Rot proofness) | Anaerobic bacteria | 0 | 0 | 0 | 0 | 0 | 0 | 0 | 0 | 0 | 0 | $10^5$ | 0 | 0 | $10^6$ |
| | Sulfate-reducing bacteria | 0 | 0 | 0 | 0 | 0 | 0 | 0 | 0 | 0 | 0 | $10^6$ | 0 | 0 | $10^6$ |
| | Fungi | 0 | 0 | 0 | 0 | 0 | 0 | 0 | 0 | 0 | 0 | $10^4$ | 0 | 0 | $10^3$ |
| | Odor | no | no | no | no | no | no | no | no | no | no | *4 | no | no | *4 |
| Rust proofness/50 times (500 times in Example 9) | | pass | pass | pass | pass | pass | pass | pass/rust | pass | pass/rust | pass | pass | pass | pass | pass |
| Emulsion or solution stability | | *5 | *5 | *5 | *5 | *5 | *5 | *5 | *5 | *5 | *6 | *5 | *5 | *5 | *5 |

TABLE 1-continued

| | Example | | | | | | | | | | Comparative Examples | | | |
|---|---|---|---|---|---|---|---|---|---|---|---|---|---|---|
| | 1 | 2 | 3 | 4 | 5 | 6 | 7 | 8 | 9 | 10 | 1 | 2 | 3 | 4 |
| Deterioration test | good | good | good | good | good | good | good | good | good | good | good | *7 | *7 | good |

*1 $HOOC(CH_2)_5CH(C_2H_5)(CH_2)_{10}COOH$

*2 A mixed emulsifier of nonionic surface active agent and anionic surface active agent.
*3 Naphthenic mineral oil of 8 cst (40° C.) to which 5 wt % of sulfurized fat was added.
*4 bad odor
*5 no separation
*6 small amount of separation
*7 viscous substance formed heterogenous
*8 Nitrogen compound
*9 Carboxylic acid In examples where nitrogen compound and carboxylic acid were used, reaction products thereof were used, except for Example 10 where they were respectively added without previously reacting them.

What is claimed is:

1. An aqueous lubricant comprising a bactericidal amount of an additive selected from the group consisting of a piperazine compound of formula I:

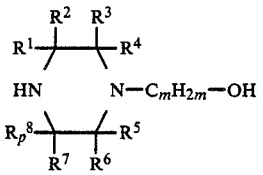

[I]

wherein $R^1$, $R^2$, $R^3$, $R^4$, $R^5$, $R^6$, $R^7$ and $R^8$ each represents hydrogen atom or an alkyl group of 1–18 carbon atoms and m is an integer of 2–5 and a reaction product of said compound of formula I with a carboxylic acid of 2–55 carbon atoms; and a lubricating amount of a lubricating oil distinct from said piperazine compound.

2. An aqueous lubricant according claim 1 wherein $R^1$–$R^8$ represent hydrogen atom and alkyl group of 1–3 carbon atoms and m is 1–3.

3. An aqueous lubricant according to claim 1 wherein $R^1$–$R^8$ represent hydrogen atom and m is 2 or 3.

4. An aqueous lubricant according to claim 1 wherein the carboxylic acid is a monovalent or divalent carboxylic acid of 4–40 carbon atoms.

5. An aqueous lubricant according to claim 1 wherein the carboxylic acid is a monovalent or divalent carboxylic acid of 10–20 carbon atoms.

6. An aqueous lubricant according to claim 1 wherein the carboxylic acid is oleic acid, sebacic acid or 7-ethyloctadecanedioic acid.

7. An aqueous lubricant according to claim 1, further comprising an emulsifying amount of an emulsifier.

8. An additive aqueous lubricant according to claim 7 wherein the emulsifier is a mixed emulsifier of a nonionic surface active agent and an anionic surface active agent.

9. An aqueous lubricant according to claim 7 wherein the lubricating oil is a mineral oil or a synthetic oil.

10. An aqueous lubricant according to claim 7 wherein the lubricating oil is a naphthenic mineral oil of 2–500 cst (40° C) to which 0.5–30% by weight of sulfurized fatty oil is added.

11. An aqueous lubricant comprising a bactericidal amount of an additive selected from the group consisting of a piperazine compound of the following formula:

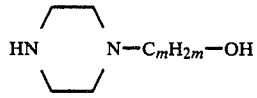

[2]

wherein m is an integer of from 1 to 3 and a reaction product of said piperazine compound of formula 2 with a carboxylic acid having from 2 to 55 carbon atoms; and a lubricating amount of a lubricating oil distinct from said piperazine compound.

12. An aqueous lubricant according to claim 11 wherein the piperazine compound is selected from the group consisting of N-(hydroxymethyl)piperazine, N-(2-hydroxyethyl)piperazine, and N-(3-hydroxypropyl)-piperazine.

13. An aqueous lubricant comprising a bactericidal amount of an additive selected from the group consisting of at least one piperazine compound selected from the group consisting of N-(hydroxymethyl)piperazine, N-(2-hydroxyethyl)piperazine, and N-(3-hydroxypropyl)piperazine and a reaction product of said piperazine compound with a carboxylic acid of from 2 to 55 carbon atoms; and a lubricating amount of a lubricating oil distinct from said piperazine compound.

* * * * *

UNITED STATES PATENT AND TRADEMARK OFFICE

CERTIFICATE OF CORRECTION

PATENT NO. : 4,781,846
DATED : November 1, 1988
INVENTOR(S) : Hideo KANAMORI

It is certified that error appears in the above-identified patent and that said Letters Patent is hereby corrected as shown below:

| | |
|---|---|
| Column 1, line 32 | Before "agents", insert -- lubricating -- |
| Column 1, line 38 | Delete "inventin", insert therefor -- invention -- |
| Column 3, line 40 | Delete "andunsaturated", insert therefor -- and unsaturated -- |
| Column 6, line 12 | Delete "methyhlenebis", insert therefor -- methylenebis -- |
| Column 7, line 19 | Delete "examines", insert therefor -- examined -- |
| Column 10, line 15 | Delete "additive" |

Signed and Sealed this

Tenth Day of December, 1991

*Attest:*

HARRY F. MANBECK, JR.

*Attesting Officer*

*Commissioner of Patents and Trademarks*